US009305460B1

(12) United States Patent
Aza

(10) Patent No.: US 9,305,460 B1
(45) Date of Patent: Apr. 5, 2016

(54) ROADWAY WARNING LIGHT DETECTOR AND METHOD OF WARNING A MOTORIST

(71) Applicant: John Justine Aza, Phoenix, AZ (US)

(72) Inventor: John Justine Aza, Phoenix, AZ (US)

( * ) Notice: Subject to any disclaimer, the term of this patent is extended or adjusted under 35 U.S.C. 154(b) by 183 days.

(21) Appl. No.: 14/064,301

(22) Filed: Oct. 28, 2013

(51) Int. Cl.
*G08G 1/0962* (2006.01)

(52) U.S. Cl.
CPC ..... *G08G 1/09623* (2013.01)

(58) Field of Classification Search
CPC ..... B60Q 1/44; B60Q 1/00; B60Q 9/008
USPC ..... 340/479, 439, 435
See application file for complete search history.

(56) References Cited

U.S. PATENT DOCUMENTS

| | | | | |
|---|---|---|---|---|
| 4,775,865 | A | 10/1988 | Smith et al. | |
| 4,908,616 | A | 3/1990 | Walker | |
| 5,635,920 | A | 6/1997 | Pogue et al. | |
| 5,819,198 | A | 10/1998 | Peretz | |
| 5,940,010 | A | 8/1999 | Sasaki et al. | |
| 6,150,932 | A | 11/2000 | Kenue | |
| 6,232,887 | B1 | 5/2001 | Carson | |
| 6,262,673 | B1 | 7/2001 | Kalina | |
| 6,442,473 | B1 | 8/2002 | Berstis et al. | |
| 6,760,061 | B1 | 7/2004 | Glier et al. | |
| 6,985,073 | B1 | 1/2006 | Doan | |
| 7,151,468 | B2 | 12/2006 | Cummings et al. | |
| 7,466,227 | B2 | 12/2008 | Chen et al. | |
| 8,103,449 | B2 | 1/2012 | Mudalige | |
| 8,126,480 | B2 | 2/2012 | Morison | |
| 2002/0101360 | A1 | 8/2002 | Schrage | |
| 2009/0176512 | A1 | 7/2009 | Morrison | |
| 2012/0044066 | A1* | 2/2012 | Mauderer et al. | 340/479 |
| 2014/0125474 | A1* | 5/2014 | Gunaratne | 340/439 |

* cited by examiner

*Primary Examiner* — Albert Wong
(74) *Attorney, Agent, or Firm* — Invention To Patent Services; Alex Hobson

(57) ABSTRACT

A warning light detector and system to alert a motorist of warning lights is provided. The warning light detector includes a camera that takes digital images of a field of view in front of the automobile, and a detection program to detect any warning lights analyzes these digital images. A control system of the detector activates an alert feature, such as a sound and/or light, to alert the motorist of a warning light when one has been detected by the detection program.

An alert feature may be a sound emitted from a speaker or light that flashes and the alert feature may be configured on the detector or be transmitted through the automobile's stereo, warning, or navigational system, for example. A detector may be a mobile device, such as a mobile phone and a warning light detector application program may be downloaded to the mobile device.

15 Claims, 6 Drawing Sheets

ROADWAY WARNING LIGHT DETECTOR AND METHOD OF WARNING A MOTORIST

BACKGROUND OF THE INVENTION

1. Field of the Invention

The present invention relates to a motorist alert detector and system to alert motorist of warning lights while driving.

2. Background

Distracted motorist and cluttered roadways make it more and more difficult for motorist to see warning lights, such as a red or yellow traffic light, while driving. Motorist that talk on the phone or converse with passengers may be distracted and not notice a warning light in enough time to react in a safe manner. In addition, roadways may be cluttered with signs and lights, such as advertisements, that make it difficult to discern traffic-warning lights.

There is a need for a warning light detector and system to alert motorist of warning lights.

SUMMARY OF THE INVENTION

The invention is directed to a warning light detector and system to alert motorist of warning lights. The warning light detector comprises a camera that takes digital images of a field of view in front of the automobile, and these digital images are analyzed by a detection program having a detection algorithm to detect any warning lights. A control system of the detector activates an alert feature, such as a sound and/or light, to alert the motorist of a warning light when one has been detected by the detection program.

An alert feature may be a sound t emitted from a speaker or light that flashes, for example, configured on the detector. An alert feature or features may be located on the detector or may be part of the vehicle and controlled by the control system of the warning light detector. A vehicle coupling may interface the detector with the vehicle and a vehicle speaker, such as those coupled with the vehicle's radio, may be used to alert the driver of a warning light. Music playing through the vehicle's speakers may be interrupted and a warning sound may be emitted, for example. A vehicle coupling cable may connect with the vehicle, such as through an auxiliary input to the vehicle, such as an audio input. Any combination of alert features may be utilized in the invention, including light or sound alert features configured on the detector and/or interfaced through the vehicle. A vehicles' radio speaker and warning lights on the dash may be utilized for example.

The detector may be coupled with and interface with the vehicle, whereby information about the vehicle, such as speed may be used in by the computer program of the control system to determine if an alert feature should be activated. For example, the detection program may detect a red stop light, and if the speed of the vehicle is above a limit value, an alert feature may be activated. If however, the speed of the vehicle is below a certain value, then no alert signal may be activated. In addition, the size of a warning light, as measured by the detector, may be used by the detection program to estimate how far away the warning light is from the vehicle. This calculated distance to the warning light from the vehicle, along with the speed of the vehicle, may be used to determine if an alert feature should be activated. In another embodiment, the control system of the warning light detector may use speed input from the vehicle to determine if the vehicle is decelerating. If the vehicle is not decelerating and a warning light is detected, an alert feature may be activated.

A detector may comprise a global positioning system (GPS) that provides vehicle speed data to the detection program. In addition, a GPS, along with a roadway position software, may be used to predict intersections approaching and thereby aid in the detection's program ability to appropriately detect warning lights. The roadway position software, along with the GPS, may confirm that an intersection is approaching, thereby providing additional input to the detection program, whereby if a red or yellow light is detected in the field of view, an alert feature may be activated. Again, speed of the vehicle may be used by a detection program utilizing a GPS and roadway position software.

The warning light detector, as described herein, may be configured to detect any type of warning light including, traffic lights including yellow and/or red traffic lights, stop lights, roadway warning lights, such as flashing yellow lights, emergency vehicle lights, secondary vehicle brake lights, roadway worker and/or construction lights, and the like. The detector comprises a computer program with any number of detection programs to analyze digital images, captured by the detector, for warning lights. A detection program may be configured to analyze for red and/or yellow lights within the digital image. The location, shape, intensity, brightness and/or color of a light within an image may be used to determine if the light in the image is a warning light. For example, the computer program may comprise a function to determine the location of a light within the field of view of the digital image. If the light is within a "high occurrence designated location" within the field of view, a light may be determine to be a warning light more readily that if the same light were in some other location of the field of view of the image. For example, a preferential region, such as a top region of the image, may be analyzed more quickly or first, for lights that may be warning light. The remaining region of the image, or the lower portion, may be analyzed after the high occurrence designated location. A top region, or high occurrence designated location may be the top 10%, top 25%, top 35%, top 50% or any range of field of view extending down from the top of the field of view. Most traffic lights and in particular stop lights, are usually positioned overhead of an intersection, therefore analysis of this region of the field of view may provide quick determination of a traffic light in this region. The detection program may use shape of light in a particular region of the field of view, as well as color, to make a determination of a light being a warning light.

A detector, as described herein, comprises a camera having a means to capture a digital image, such as a lens, and may comprise zooming capabilities. A camera may have a physical zooming lens or a digital zoom may be incorporated into the detection program. The detector comprises a housing and may comprise one or more alert features, such as a light or sound feature. The detector may be coupled to a mount having a base, whereby the mount can be quickly and easily positioned on the dash of a vehicle. The mount may comprise one or more suction cups, whereby the mount can be detachably attached to the vehicle, such as to a window or dash. Any suitable way of detachably attaching the mount and detector to the vehicle may be used. In other embodiments, the detector is configured as part of the vehicle and may be built into the dash or any other suitable location, such as from attached to the inside roof of the vehicle or the back-side of the rear view mirror and the like.

A mount may comprise an actuator to rotate or otherwise move the detector, whereby a suspected warning light may be more effectively analyzed by positioning the suspected warning light more centrally within the field of view. An actuator may rotate the detector from side to side, and/or up and down.

The warning light detector may also automatically zoom-in on a suspected warning light to ascertain if it is a warning light or the color of the light.

The detector may be a mobile device and the control system may comprise an "application program" for the mobile device. The mobile device may be a mobile telephone and the application program may be down-loaded from the internet, for example.

The motorist alert system, as described herein, may analyze any suitable number of images per second, such as one or more, two or more, three or more, four or more, five or more, six or more, ten or more, twenty or more and any range between and including the images per second values provided. The camera may capture any suitable number of digital images per second including one or more, two or more, three or more, four or more, five or more, six or more, ten or more, twenty or more and any range between and including the images per second values provided.

The summary of the invention is provided as a general introduction to some of the embodiments of the invention, and is not intended to be limiting. Additional example embodiments including variations and alternative configurations of the invention are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
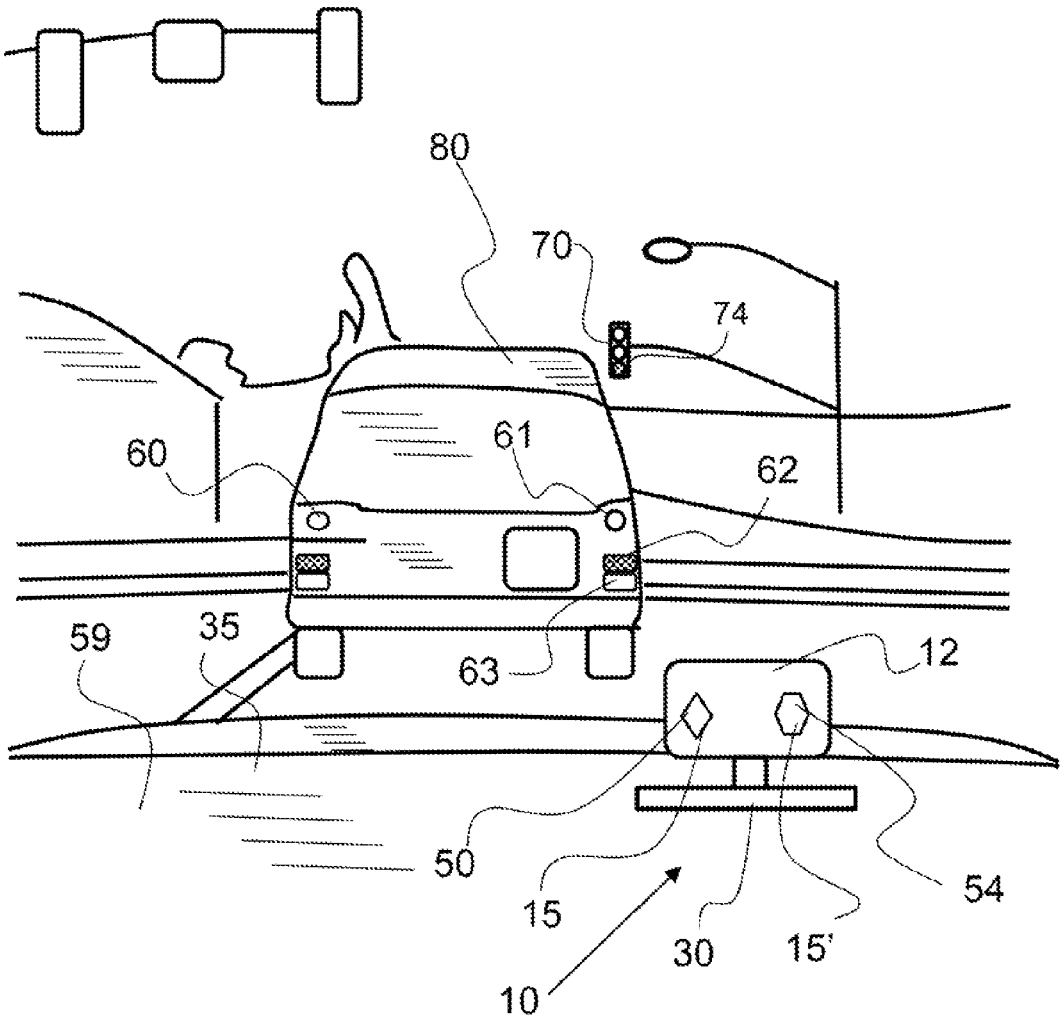

FIG. 1 shows a motorist's view of an exemplary motorist alert system comprising a detector configured on a vehicle dash.

Figure 2:
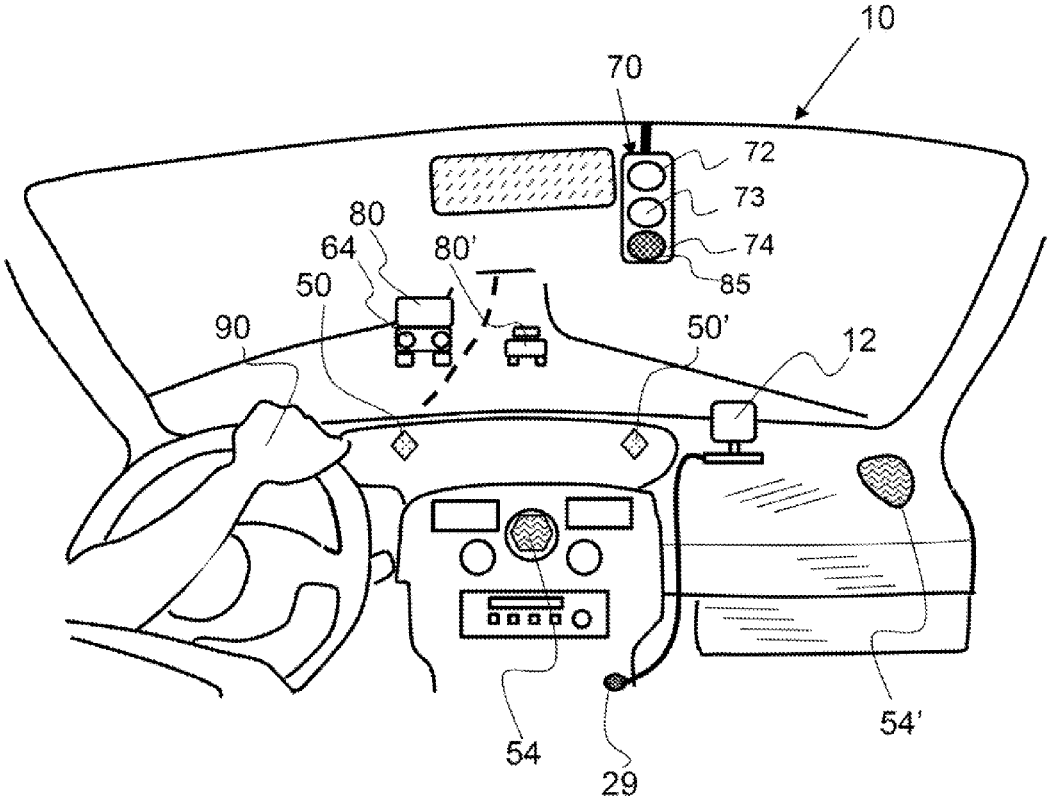

FIG. 2 shows a perspective view of an exemplary motorist alert system comprising a detector configured on a vehicle dash and coupled with the vehicle.

Figure 3:
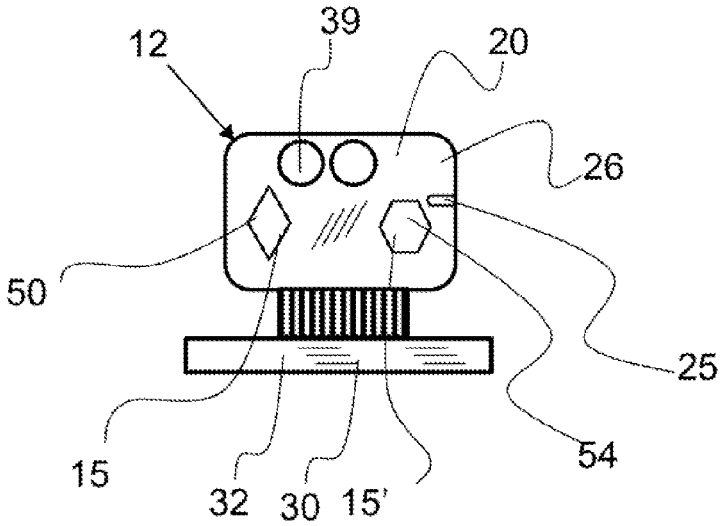

FIG. 3 shows a back view of an exemplary detector, as described herein.

Figure 4:
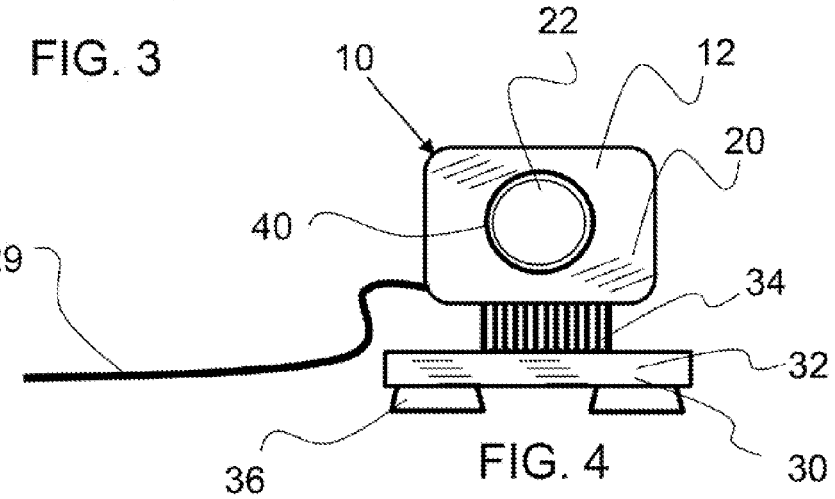

FIG. 4 shows a front view of an exemplary detector, as described herein.

Figure 5:
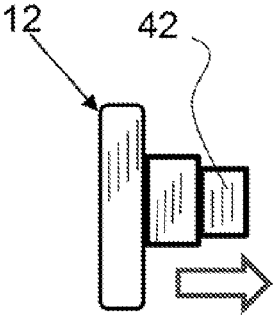

FIG. 5 shows a side view of an exemplary detector having a zoom lens, as described herein.

Figure 6:
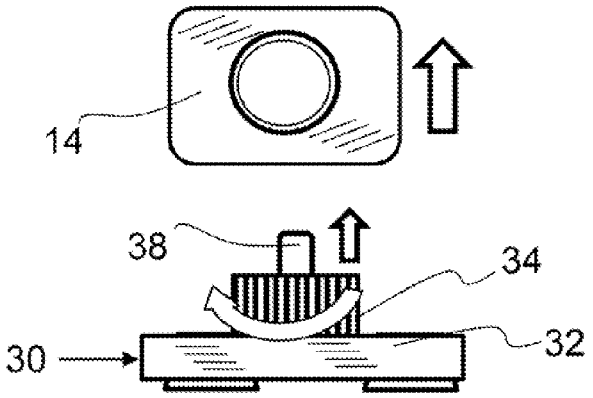

FIG. 6 shows a front view of an exemplary detector that is detached from a mount, as described herein.

Figure 7:
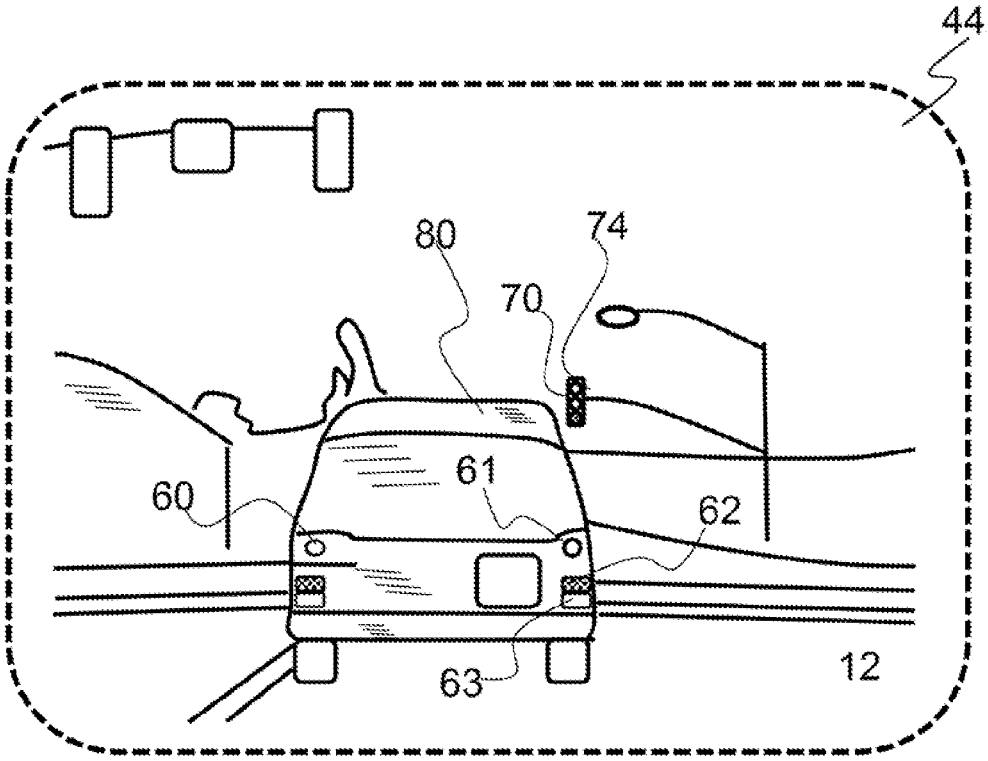

FIG. 7 shows an exemplary field of view of a camera.

Figure 8:
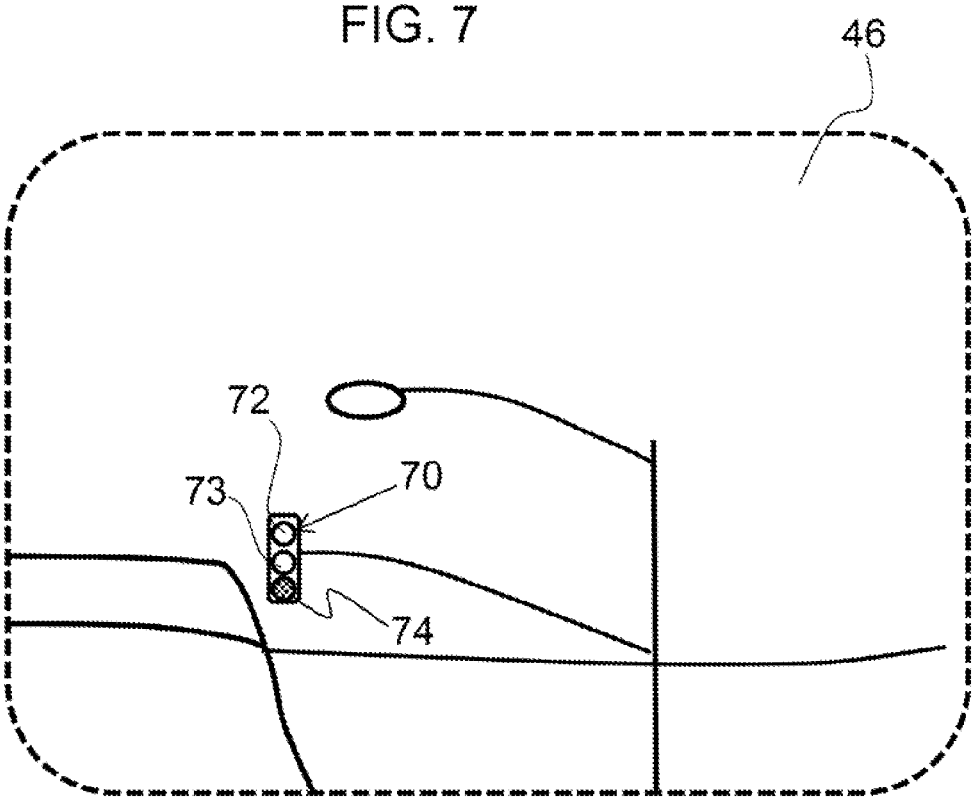

FIG. 8 shows an exemplary zoomed-in field of view of a camera.

Figure 9:
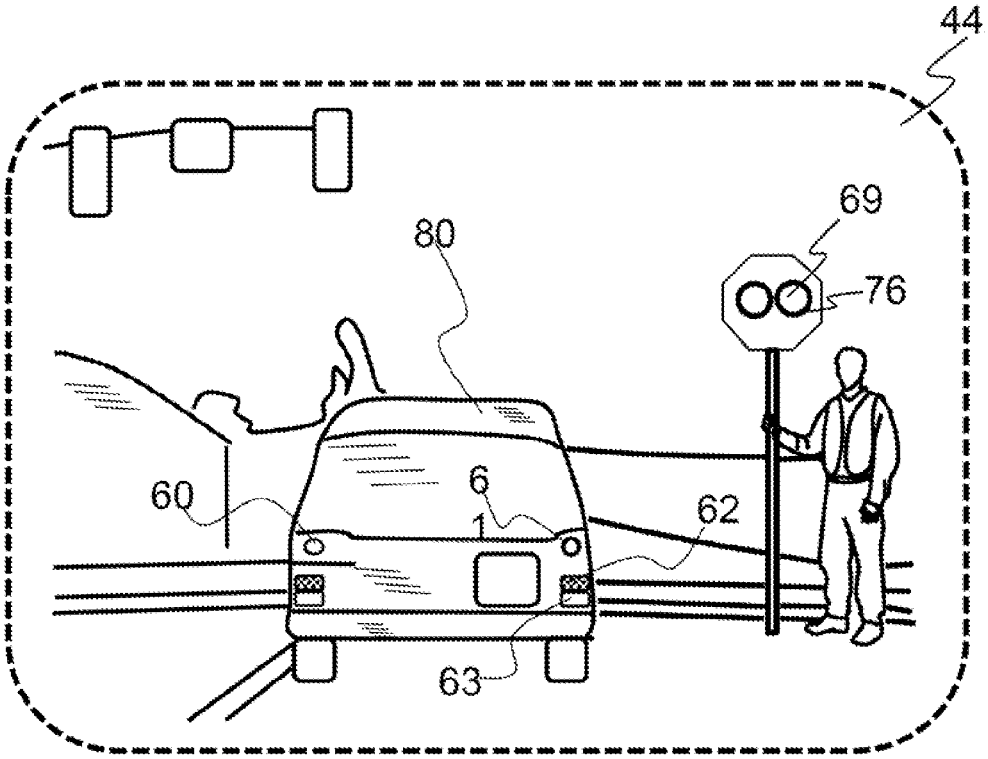

FIG. 9 shows an exemplary field of view of a camera.

Figure 10:
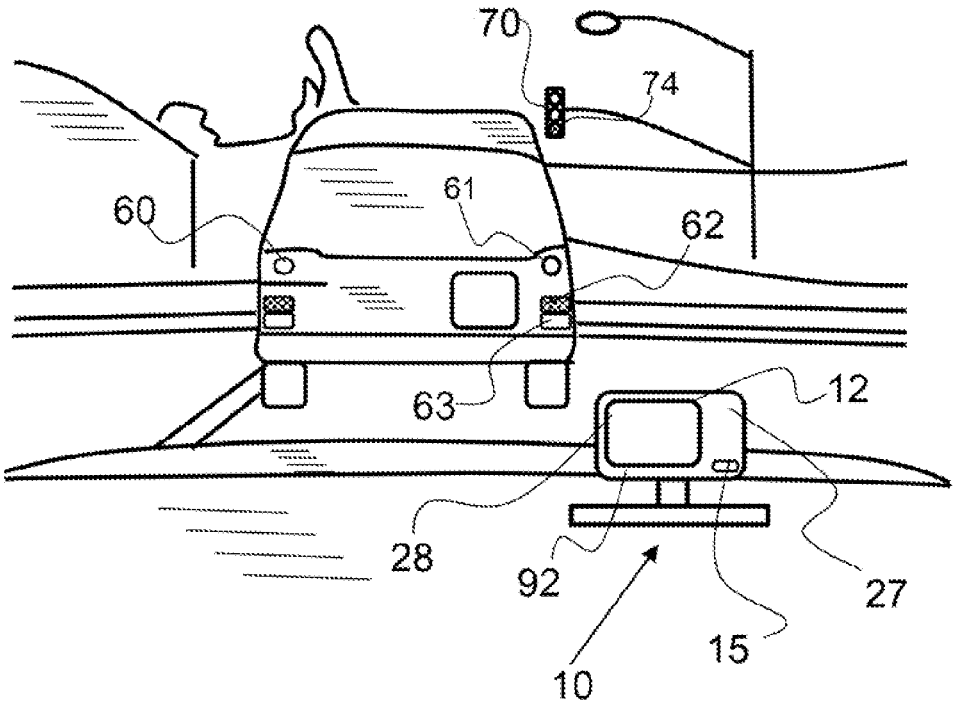

FIG. 10 shows a perspective view of an exemplary mobile device configured as a detector, as described herein.

Figure 11:
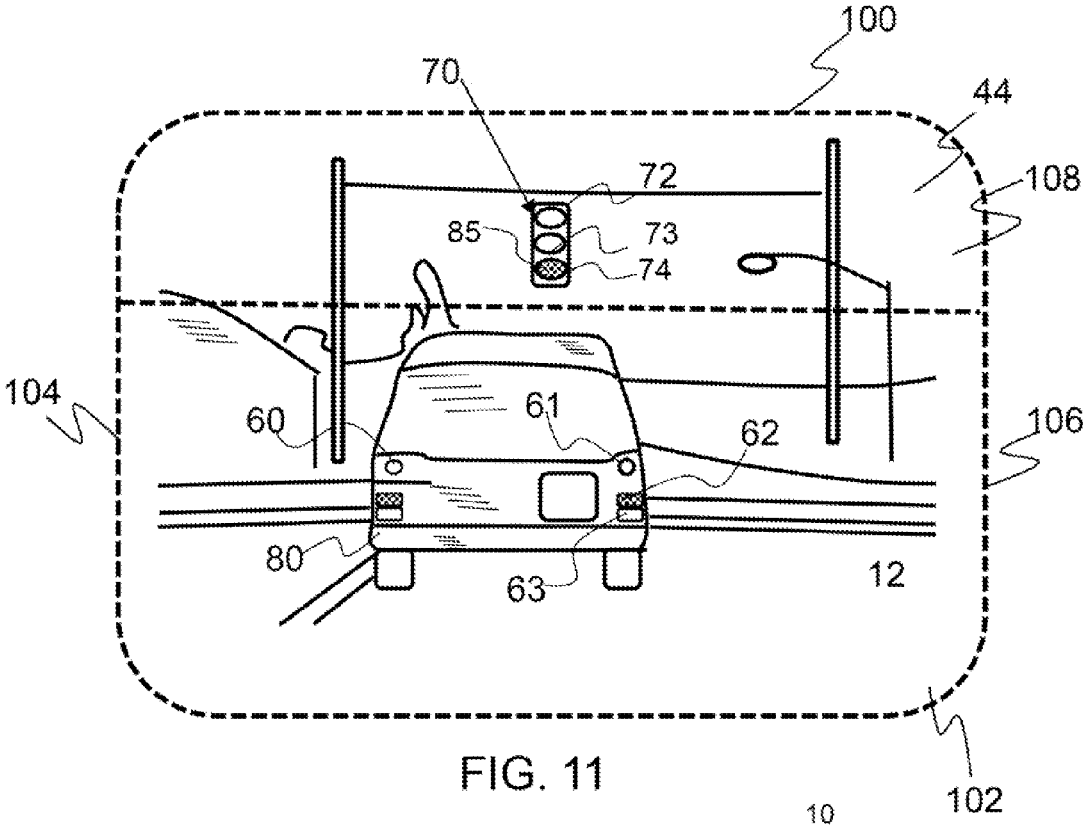

FIG. 11 shows an exemplary field of view of a camera having a preferential region along the top portion of the field of view as indicated by the horizontal dashed line extending across the image.

Figure 12:
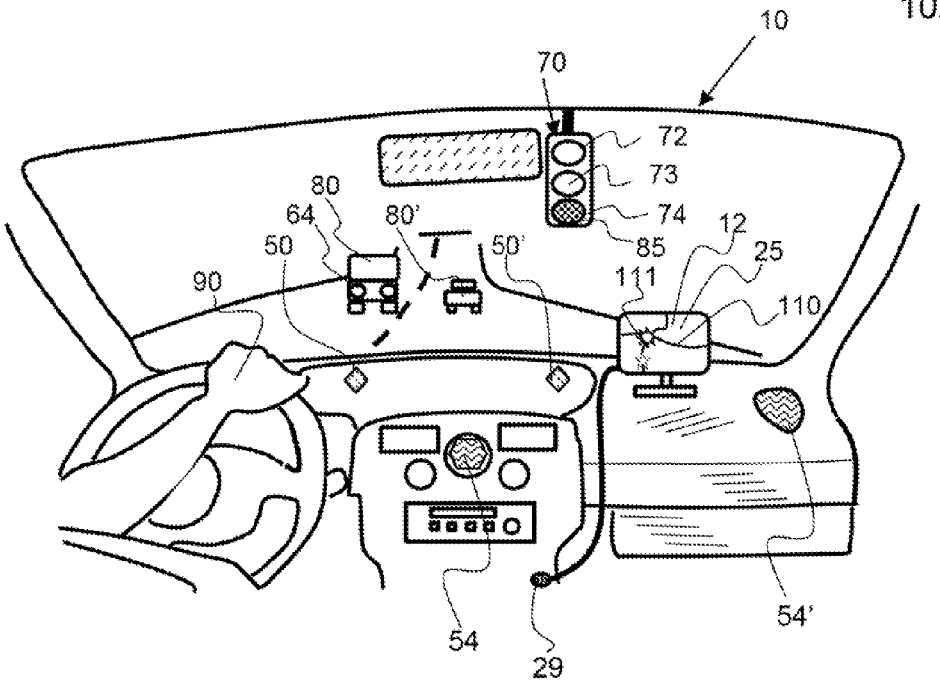

FIG. 12 show a perspective view of an exemplary motorist alert system comprising a detector having a GPS map displayed on a detector screen.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown if FIG. 1, an exemplary motorist alert system 10 comprises a detector 12 configured on a vehicle dash 35. The detector comprises two alert features 15, 15', an alert light 50 and a speaker 54 configured on the back-side of the detector. The camera (not shown), is configured on the front side of the detector. The detector is coupled to a mount 30. A secondary vehicle 80 having a plurality of secondary vehicle lights 60, including brake lights 61, turn signals 62 and taillights 63 is in front of the primary vehicle 59, having the detector as shown. A traffic light 70, or stop light, having a red light 74 is shown over an intersection.

As shown in FIG. 2, an exemplary motorist alert system 10 comprises a detector 12 configured on a vehicles dash and coupled with the vehicle by a vehicle coupling 29. A vehicle coupling may plug into an auxiliary jack or audio input of the vehicle. A traffic light 70 is shown having a green light 72, yellow light 73, and a red light 74 that is on, as indicated by the cross-hashing in the detectors field of view. The red and yellow lights are considered warning lights 85. The detector has detected the red light 74 as a warning light 85 and has sent a command through the vehicle coupling 29, to activate alert lights 50, 50' that are part of the vehicle, and an alert sound through the speaker 54, 54' which are also part of the vehicle. Alert features that are an integral part of a vehicle are vehicle alert features, as used herein. Also shown in FIG. 2 are two secondary vehicles 80, 80'. Secondary vehicle 80 is an oncoming vehicle having headlights, which are considered warning lights, for the purposes of this invention.

As shown in FIG. 3, an exemplary detector 12, as described herein comprises a plurality of alert features 15, including an alert light 50 and an alert speaker 54. In addition, the detector comprises a user interface 39, comprising a plurality of buttons. It is to be understood that any suitable user interface may be used, including touch screens, keyboards, steering wheel buttons and the like. The detector 12 also comprises a control system 26 within the enclosure 20 that may comprise a data processor or chip and all other suitable features to control the system. The control program may be loaded in any suitable way. The detector may be provided with a control program or the program may be down-loaded from the internet or any other digital media source. A thumb drive may be plugged into a USB port, not shown, for example. The detector 12 also comprises a GPS 25.

As shown in FIG. 4, an exemplary detector 12, comprises a camera 22 comprising a lens 40. The detector is configured on a mount 30 having a base 32 and a plurality of suction cups 36. The detector has a vehicle coupling 29 extending from the enclosure 20.

As shown in FIG. 5, an exemplary detector 12 has a zoom lens 42. The zoom lens 42 may automatically zoom when the control program directs it to do so.

As shown in FIG. 6, an exemplary detector 12 is detached from a mount 30 having an actuator 34, whereby the detector can be rotated from side to side as indicate by the arced arrow. In addition, the mount comprises a vertical adjuster 38, whereby the detector can be moved up or down as desired by the user. For example, some vehicles may have an obstruction that may require the user to adjust the vertical position of the detector.

As shown in FIG. 7, an exemplary field of view 44 of a detector's camera is shown within the dashed line. Any number of warning lights are present in the field of view.

As shown in FIG. 8, an exemplary zoomed-in field of view 46 of the field of view 44 shown in FIG. 7, is shown within the dashed line. The field of view as shown in FIG. 7 may not have been suitable for detecting a warning light. The analysis of the field of view image shown in FIG. 7 may have alerted the detection program of a possible warning light on the traffic light 70. The control system may have then directed the camera to move and/or zoom in on the suspected warning light. This enhanced field of view shown in FIG. 8 may provide for better analysis of the traffic light and aid in the determination that a red light 74 is on.

As shown in FIG. 9, an exemplary field of view 44 comprises a road worker holding a roadway warning light 76. The flashing lights 69 may be used to warn motorist of upcoming road construction and direct them to slow down. The flashing roadway warning lights are considered warning lights, as described herein.

As shown in FIG. 10, an exemplary mobile device 27 is configured as a detector. The mobile device shown is a mobile telephone 28 having a user interface, a camera and a detection program 92 that may be an "application software" program. The mobile telephone also comprises an alert feature 15, such as a speaker.

As shown in FIG. 11, an exemplary field of view of a camera has a preferential region 108 along the top portion of the field of view 44 as indicated by the horizontal dashed line extending across the image. The detection program may analyze image elements in a preferential region of an image differently than image elements, or suspected warning lights, in other regions of the field of view of the image. The control system may, for example, zoom in on objects, or suspected warning lights within a preferential region to better make an analysis.

As shown in FIG. 12, a warning light detector 12 comprises a display screen having a map 110 displayed thereon. A map may be generated by a GPS and roadway software program and may show the position of the automobile and upcoming warning light 112 locations or intersections.

DEFINITIONS

A detector, as used herein, is a device that comprises a camera and a detection algorithm that analyzes digital images taken by said camera to determine if a warning light is in the field of view.

A warning light, as used herein, is a light configured to warn a motorist that they may need to slow down and/or stop and includes, traffic lights that may be yellow or red, vehicular brake lights, turning lights and back-up lights, road way warning lights, workman lights, police and/or emergency vehicle lights and the like.

A camera, as used herein, is any suitable device that can take a digital image of a field of view and in some embodiments, the camera further comprises a zoom feature.

A control system, as used herein, comprises a detection algorithm to determine if a warning light may be in the field of view and an output to a warning feature or alert feature. In some embodiments, the control system is configured within the detector and in other cases, the control system is in a separate device, and/or may interfaces with or comprise a vehicle control system. For example, in one embodiment the control system comprises a control program configured within the detector that interfaces with the vehicle, whereby vehicle conditions, such as speed and whether or not the brake is being applied may be inputs into the control program. If the vehicle is going too fast as the vehicle approaches a warning light, the detection algorithm may activate an alert feature, such as a buzzing sound from a speaker. In one embodiment, the control program may interface with a vehicle control system to automatically apply the brakes if the motorist fails to do so as they approach a warning light.

In one embodiment, the motorist alert system is integral, whereby the all of the components required to alert a motorist that they are approaching a warning light are configured within one unit, such as a mobile telephone for example.

What is claimed is:

1. A motorist alert system comprising:

a) a mobile device detector comprising:

i) a camera configured to capture a digital image of a field of view;

ii) a control system comprising:

a detection program configured to detect a warning light within said field of view of said camera; and iii) an alert feature comprising a speaker for producing a sound alert, iv) a global positioning system that determines a location of the mobile device;

b) a mount configured to detachably attach the mobile device detector thereto and configured to attach to a dash or window of a vehicle;

wherein the application software program interfaces with the global positioning system of the mobile device to detect a speed of the vehicle; and wherein the sound alert is only produced when the speed of the vehicle is not decelerating as the vehicle approaches a warning light detected in the field of view by the detection program wherein at least one of the sound alert feature is activated when a warning light is detected by said detection program.

2. The motorist alert system of claim 1, wherein the application software program interfaces with the global positioning system of the mobile device to detect an intersection;

wherein the detection program is configured to detect a stop light of said intersection, and wherein the warning light is said stop light.

3. The motorist alert system of claim 1, wherein the warning light is a vehicle brake light.

4. The motorist alert system of claim 2, wherein the sound alert is only produced when the speed of the vehicle is not decelerating as the vehicle approaches the intersection and the stop light is red, as determined by the detection program.

5. The motorist alert system of claim 1, wherein the mobile device detector is portable, wherein a user may transfer the mobile device detector from one vehicle to another.

6. The motorist alert system of claim 1, wherein the mobile device detector is a mobile telephone having integrated into said mobile telephone;

a speaker for producing the sound alert;

said camera configured to capture a digital image of a field of view;

an application software program loaded onto the mobile telephone that is the detection program that analyses the digital image captured by said integrated camera to detect a warning light in the field of view.

7. The motorist alert system of claim 1, wherein the alert feature further comprises a light.

8. The motorist alert system of claim 1, wherein the mobile device detector is coupled with a speaker of said vehicle to produce the sound alert through said vehicle.

9. The motorist alert system of claim 8, wherein the mobile device detector is connected with the vehicle through a vehicle coupling and wherein a light of said vehicle is a light alert feature.

10. The motorist alert system of claim 1, wherein the mobile device detector is connected with the vehicle and wherein the control system interfaces with the vehicle to activate a brake of the vehicle when said speed of the vehicle is not decelerating as the vehicle approaches a warning light.

11. The motorist alert system of claim 1, wherein the camera comprises a zoom feature, whereby the field of view is zoomed-in on an object that is determined to be a possible warning light by the detection program and whereby the detection program further analyzes said object after said field of view is zoomed-in.

12. The motorist alert system of claim 1, wherein the mount comprises an actuator, whereby the mobile device detector attached to the mount is rotated in one or more directions by said actuator to change the field of view of the camera; and wherein the movement of the actuator is controlled by the detection program.

13. The motorist alert system of claim 1, wherein the camera takes at least one image per second for analysis by the detection program.

14. The motorist alert system comprising:

a) a mobile telephone detector that is portable, wherein a user may transfer the mobile telephone detector from one vehicle to another, and comprising:

i) a camera configured to capture a digital image of a field of view;

ii) a control system comprising an application software program loaded onto the mobile telephone, and comprising:

a detection program configured to detect a warning light within said field of view of said camera; and iii) an alert feature comprising a speaker, iv) a global positioning system that determines a location of the mobile telephone;

b) a mount configured to detachably attach the mobile telephone thereto;

wherein said camera captures at least one digital image every second for analysis by said detection program;

wherein the application software program interfaces with the global positioning system of the mobile telephone to detect a speed of the vehicle; and wherein the sound alert is only produced when the speed of the vehicle is not decelerating as the vehicle approaches a warning light detected in the field of view by the detection program;

and wherein the mount and mobile telephone detector are detachably attachable to a dash or a front window of a vehicle.

15. The motorist alert system of claim 14, wherein wherein the camera further comprises a zoom feature; and wherein the mount further comprises an actuator that is configured to rotate the mobile telephone attached to the mount in one more directions;

whereby the field of view may be adjusted to capture a second digital image of a second field of view for analysis by the detection program; and wherein the movement of the actuator is controlled by the detection program.

* * * * *